US007448815B1

(12) United States Patent
Sheu

(10) Patent No.: US 7,448,815 B1
(45) Date of Patent: Nov. 11, 2008

(54) MECHANICAL PENCIL

(76) Inventor: Rong-Lin Sheu, 16, Sanjin Biehshu, Guomin Rd., Wu Jieh Hsiang, Yilan Hsien (TW)

( * ) Notice: Subject to any disclaimer, the term of this patent is extended or adjusted under 35 U.S.C. 154(b) by 0 days.

(21) Appl. No.: 12/099,174

(22) Filed: Apr. 8, 2008

(51) Int. Cl.
*B43K 21/22* (2006.01)

(52) U.S. Cl. ..... 401/93; 401/92

(58) Field of Classification Search ..... 401/82, 401/83, 92–94
See application file for complete search history.

(56) References Cited

U.S. PATENT DOCUMENTS 5,236,271 A * 8/1993 Sakaoka ..... 401/65
6,767,150 B1 * 7/2004 Sheu ..... 401/93
7,237,972 B2 * 7/2007 Kanari et al. ..... 401/92

* cited by examiner

*Primary Examiner*—David J Walczak
(74) *Attorney, Agent, or Firm*—Leong C. Lei

(57) ABSTRACT

The mechanical pencil contains a tubular body having a bottom cap and a top cap. Inside the mechanical pencil, a tip element is positioned inside and protrudes from the bottom cap, a clamping mechanism is above the tip element with a spring therebetween, and a sliding mechanism is above the clamping mechanism. A single lead is stored in the sliding mechanism and is held by the clamping mechanism. When the lead outside the tip element is used up and the tip element is pressed, the spring is compressed and a segment of the lead is advanced into the tip element. When the tip element is released, the tip element is pushed downward by the spring and the segment of the lead is brought along with the tip element. By repeating the process a number of times, the lead would be extended out of the tip element.

3 Claims, 11 Drawing Sheets

MECHANICAL PENCIL

TECHNICAL FIELD OF THE INVENTION

The present invention generally relates to mechanical pencils, and more particularly to a mechanical pencil whose lead is automatic advanced by pressing the tip of the mechanical pencil.

DESCRIPTION OF THE PRIOR ART

A most common type of mechanical pencil is the so-called ratchet-based pencil where the lead is advanced by a button on either the end or the side of the pencil. A variation of the ratchet-based pencil is operated by shaking the pencil back and forth and a weight inside the pencil pushes the lead out of the tip of the pencil.

A common problem to the various mechanical pencils is that, when the lead is advanced too much, it is difficult to push the lead back into the pencil. A user usually has to pull the entire lead out and reinstall it, which is rather inconvenient. If the lead is already broken with a segment of the lead left inside the pencil, or the mechanical pencil is installed with two or more leads as spares, the leads are often stuck at the tip and cannot be advanced.

A major drawback of the design of the conventional mechanical pencil is that its advancing mechanism is not proper for the chamber that holds the leads. It is therefore not easy to control the amount of lead advanced. As such, the leads are usually wasted from snapping than actually used.

SUMMARY OF THE INVENTION

The primary purpose of the present invention is to provide a novel mechanical pencil to obviate the foregoing shortcomings of the conventional mechanical pencils.

The mechanical pencil contains a tubular body having a bottom cap and a top cap. Inside the mechanical pencil, a tip element is positioned inside and protrudes from the bottom cap, a clamping means is above the tip element with a spring therebetween, and a sliding means is above the clamping means. A single lead is stored in the sliding means and is held by the clamping means.

When the lead outside the tip element is used up and the tip element is pressed, the spring is compressed and a segment of the lead is advanced into the tip element. When the tip element is released, the tip element is pushed downward by the spring and the segment of the lead is brought along with advanced the tip element. By repeating the process a number of times, the lead would be extended out of the tip element without depressing any button.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
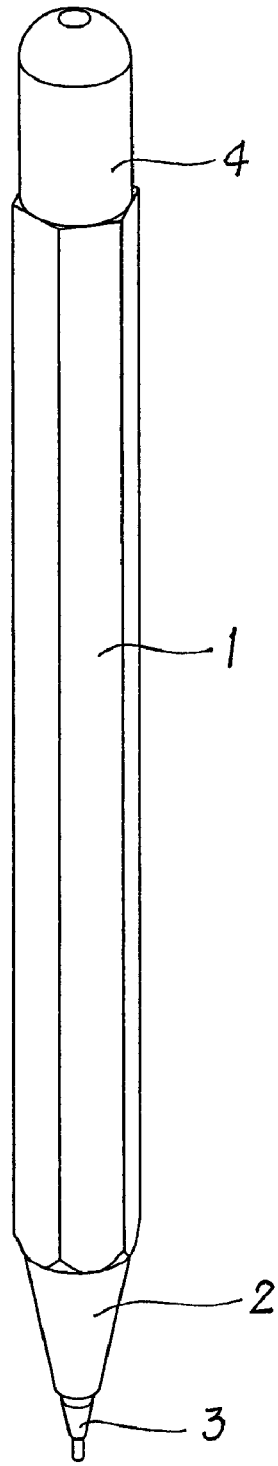
FIG. 1 is a perspective view diagram showing a mechanical pencil according an embodiment of the present invention.
Figure 2:
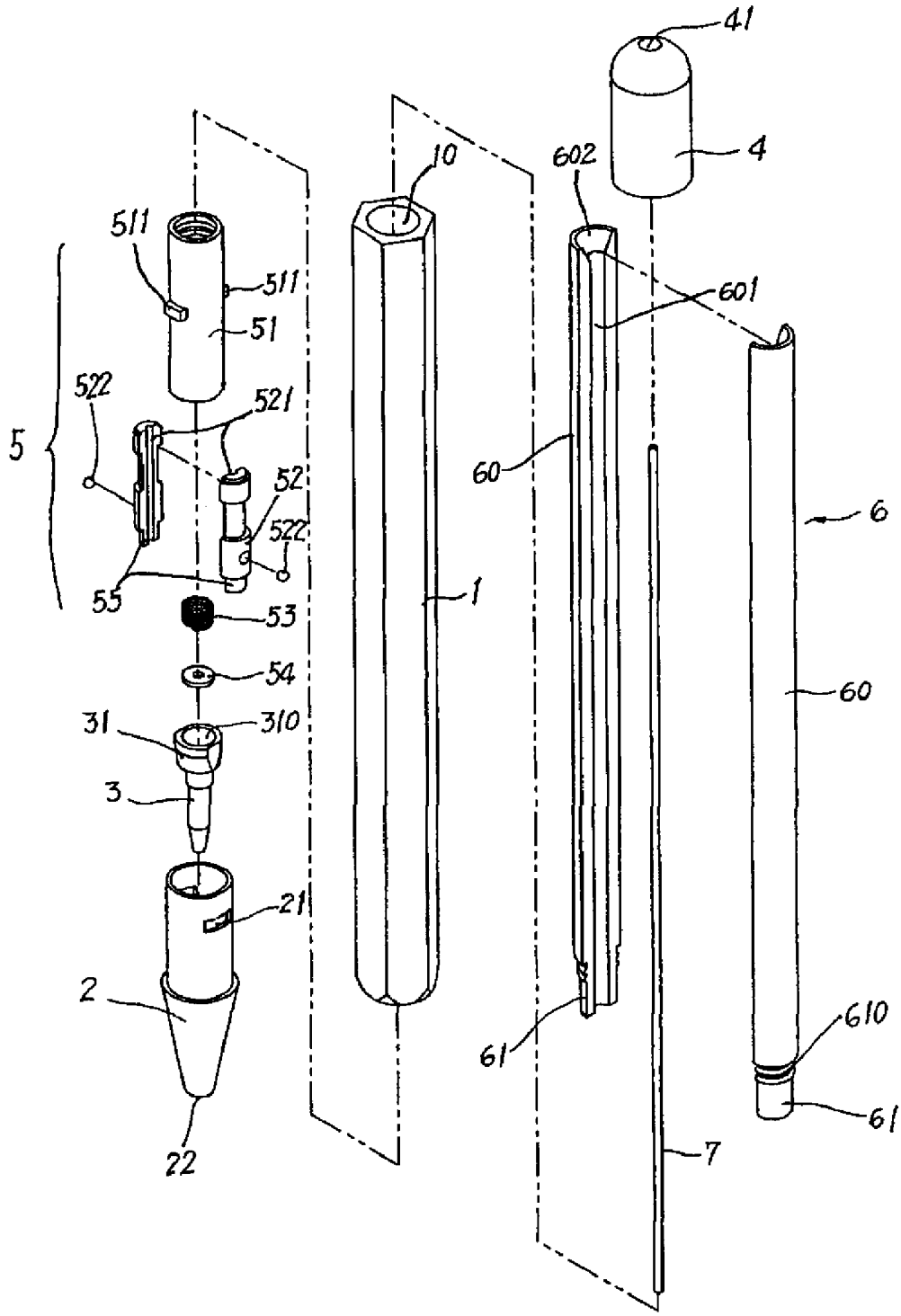
FIG. 2 is an exploded perspective view diagram showing the various components of the mechanical pencil of FIG. 1.

As shown in FIGS. 1 and 2, a mechanical pencil according to an embodiment of the present invention mainly contains a tubular body 1, a bottom cap 2 at a bottom end of the tubular body 1, a tip element 3 positioned inside the bottom cap 2, a top cap 4 at a top end of the tubular body 1, and a clamping means 5 and a sliding means 6, both inside the tubular body 1.

The tubular body 1 has an end-to-end axial channel 10. The bottom cap 2 has a hollow cylindrical body having a bottom opening 22 and two lateral slots 21 close to a top opening of the body. The tip element 3 has an elongated body having an indentation 310 at a top end 31 and penetrates through the bottom opening 22 of the bottom cap 2 after being positioned vertically inside the bottom cap 2.

The clamping means 5 contains a tube 51, two matching clamping pieces 52, a helix spring 53, and a washer 54. The washer 54 and the spring 53 are positioned inside the indentation 310 in this order. The two clamping pieces 52 are laterally joined together into a cylindrical body having an axial channel 521 and two opposing indentations (not numbered) for holding two balls 522, respectively, in the lower half of the circumference of the cylindrical body. A bottom section 55 having a smaller diameter of the cylindrical body is threaded through the spring 53 and positioned in the indentation 310 of the tip element 3. The cylindrical body is then threaded into the tube 51. The tube 51 is then positioned inside the bottom cap 2 through its top opening. In a middle section of the circumference of the tube 51, there are two opposing wedges 511 which are embedded into the two slots 21 of the bottom cap 2, respectively, so as to join the clamping means 5 and the bottom cap 2 together. The assembly of the bottom cap 2, the tip element 3, and the clamping means 5 is then threaded and fixed to the tubular body 1 through its bottom opening.

The sliding means 6 contains two matching elongated pieces 60 laterally joined together to form a cylindrical body having an end-to-end axial channel 601. At a bottom end of the cylindrical body, there are a number of rings 610 above a bottom section 61 having a smaller diameter. At a top end of the cylindrical body, the aperture of the axial channel 601 is gradually enlarged to a top opening 602. The sliding means 6 is threaded into the tubular body 1 through the axial channel 10's top opening, and the bottom end of the sliding means 6 is inserted into a top opening of the tube 51. The top cap 4, having a through hole 41 at a top end, tightly joins the top ends of the elongated pieces 60 together.

Figure 3:
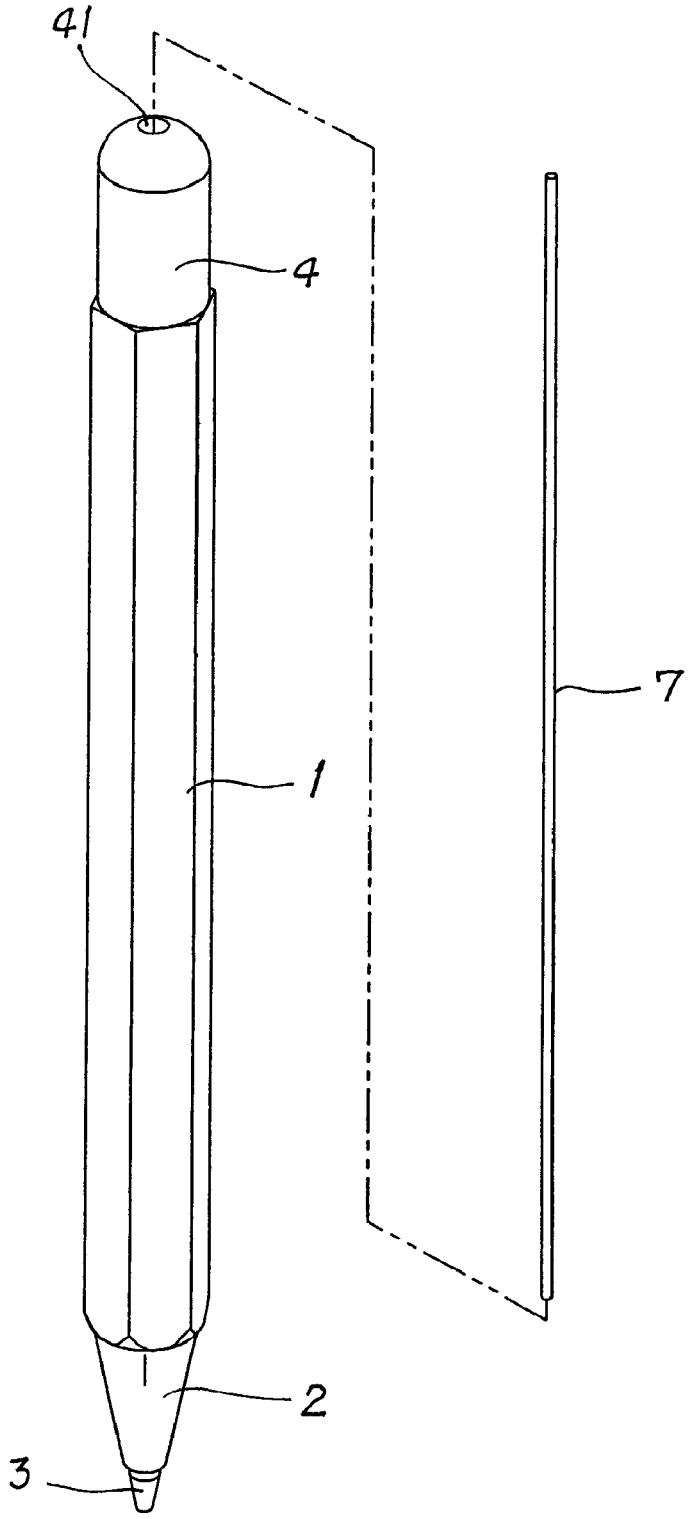
FIGS. 3 and 4 are perspective view diagrams showing the installation of a lead into the mechanical pencil of FIG. 1.
Figure 4:
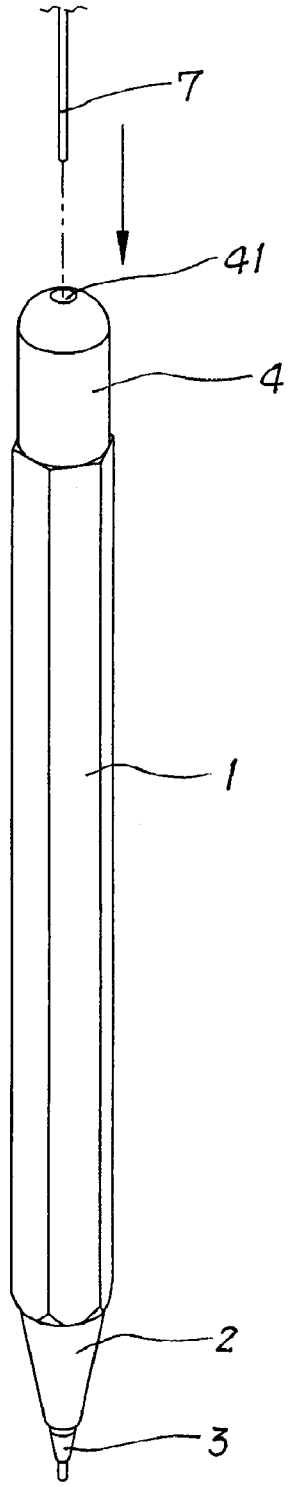
Figure 5:
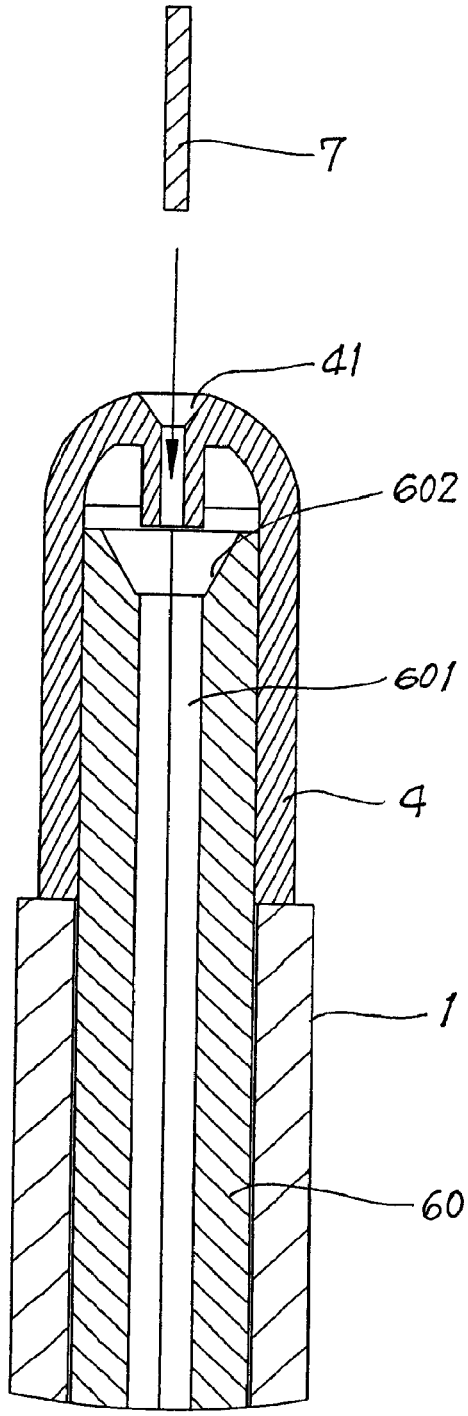
FIGS. 5 and 6 are sectional view diagrams showing the installation of a lead into the mechanical pencil of FIG. 1.

As shown in FIGS. 3 to 5, the installation of a lead 7 into the mechanical pencil is simply by threading the lead 7 into the axial channel 601 of the sliding means 6 via the through hole 41 of the top cap 4 and the top opening 602 of the axial channel 601 of the sliding means 6.

Figure 6:
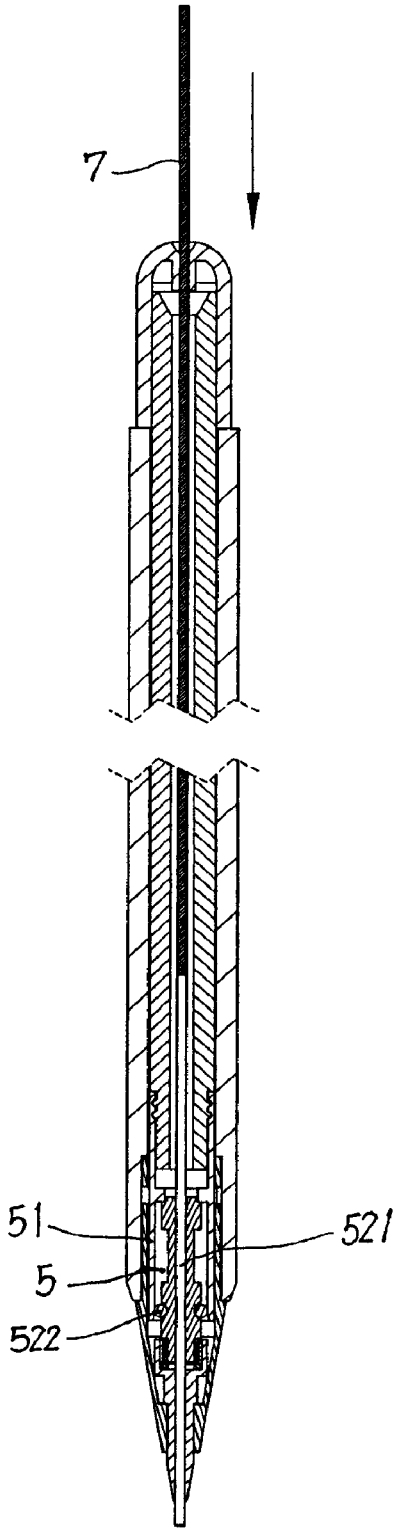
Figure 7:
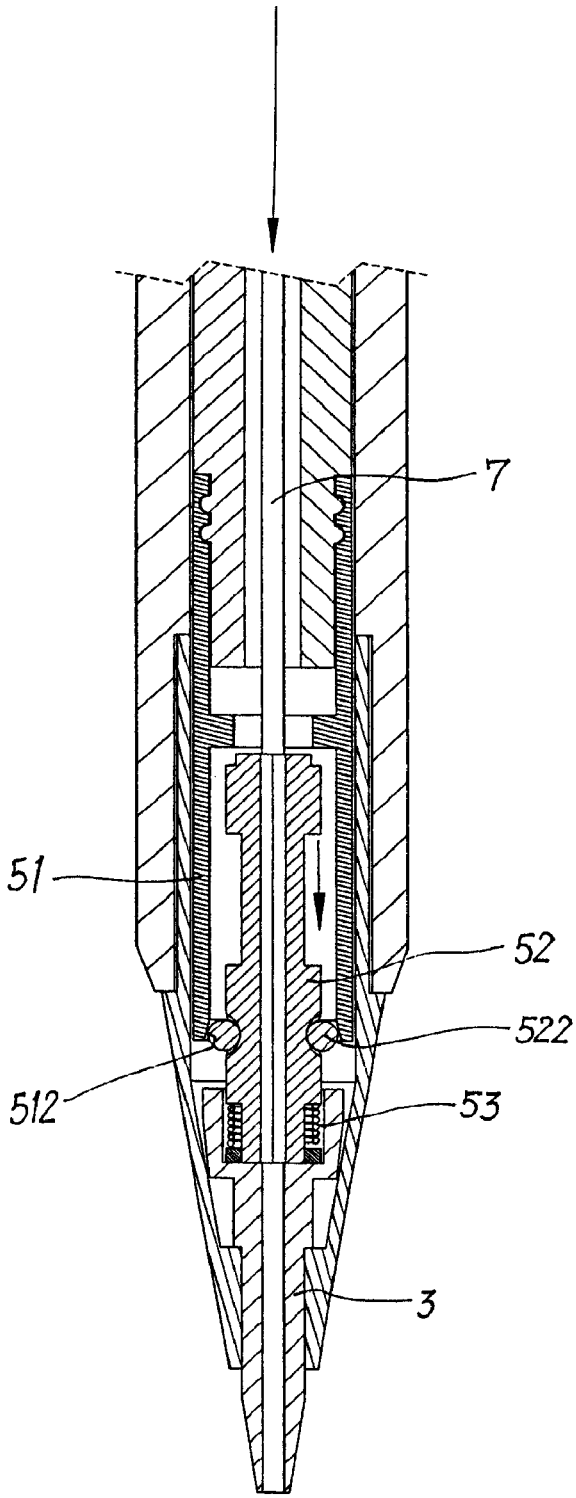
FIG. 7 is a sectional view diagram showing the mechanical pencil of FIG. 1 when its top cap is depressed.
Figure 8:
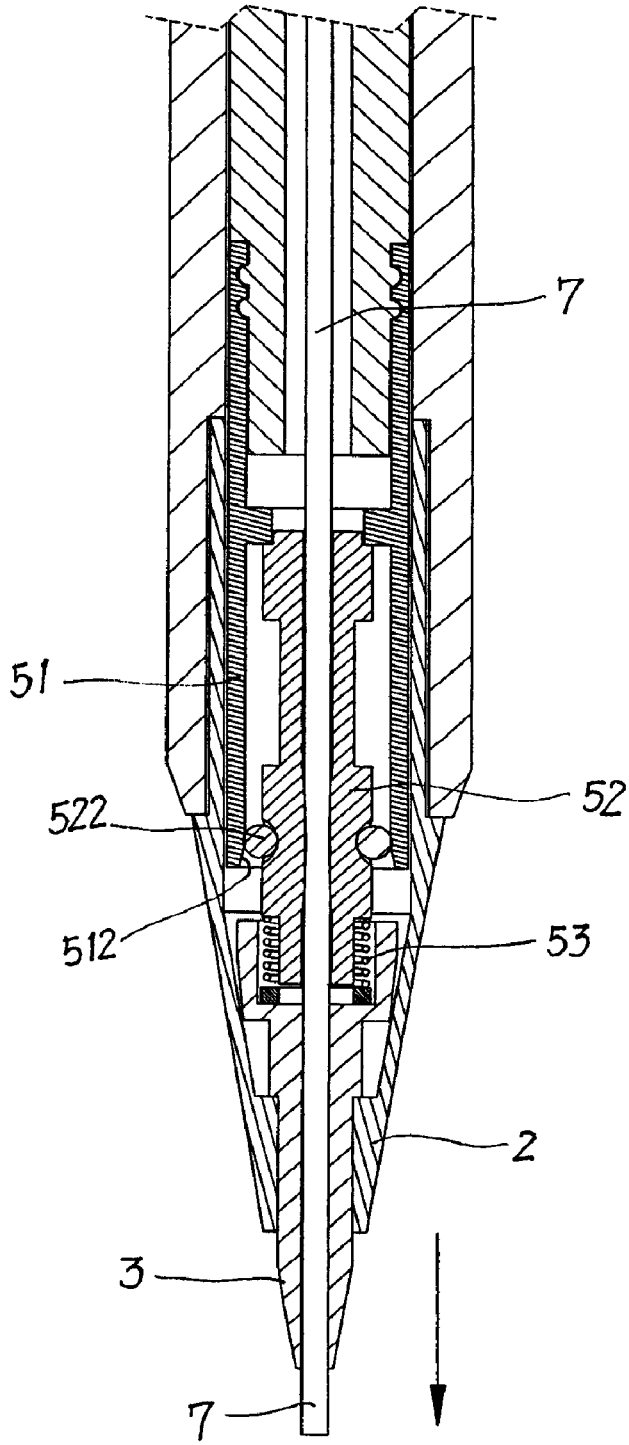
FIG. 8 is a sectional view diagram showing that a lead is extended out of a tip element of the mechanical pencil of FIG. 1.

As further shown in FIG. 6, as the balls 522 are inside and confined by the tube 51 to squeeze the clamping pieces 52, the lead 7, when it drops and reaches the clamping means 5, is clamped and held by the clamping pieces 52. By depressing the top cap 4, the clamping pieces 52 and the lead 7 are pushed downward together. As shown in FIG. 7, the spring 52 is compressed and the balls 522 roll into to a section 512 of the tube 51 which has a larger aperture. The pressure against the clamping pieces 52 is thereby lessened so that the lead 7 is able to drop until it protrudes out of the tip element 3, as shown in FIG. 8. When the top cap 4 is released, the clamping pieces 52 are pushed back into the tube 51 by the expanding spring 53 so that the balls 522, as they roll out of the section 512, again squeeze the clamping pieces 52 to hold the lead 7. The mechanical pencil is now ready for writing.

Figure 9:
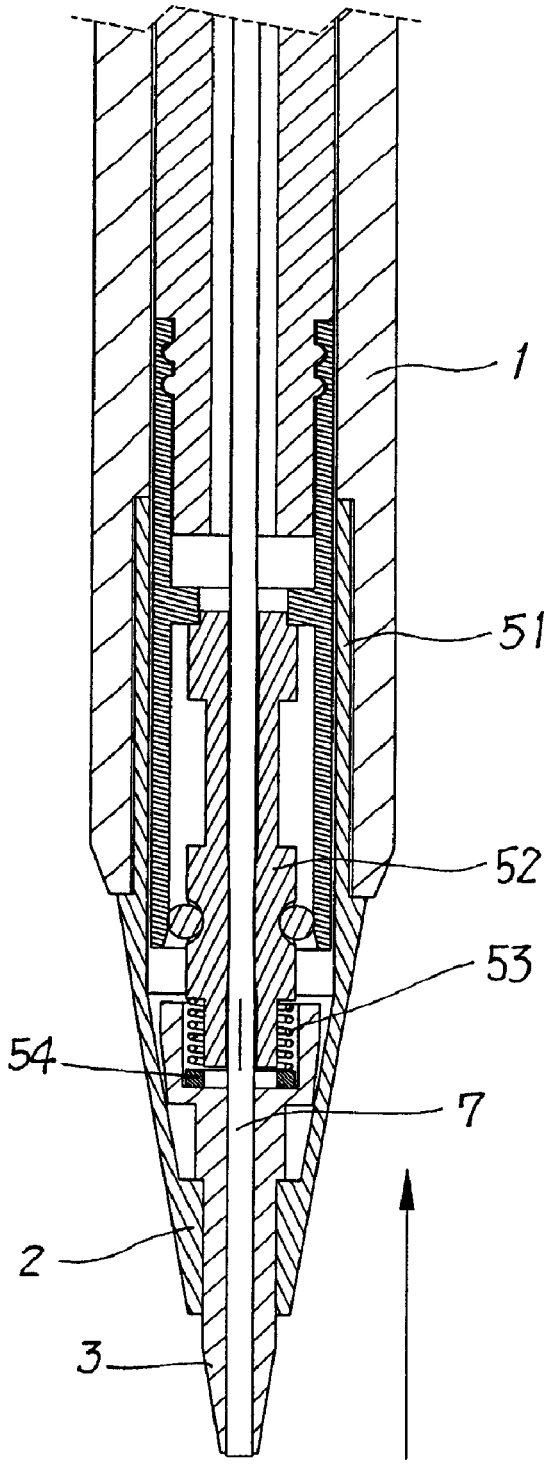
FIGS. 9 and 10 are sectional view diagrams showing that a tip element of the mechanical pencil of FIG. 1 is pressed.
Figure 10:
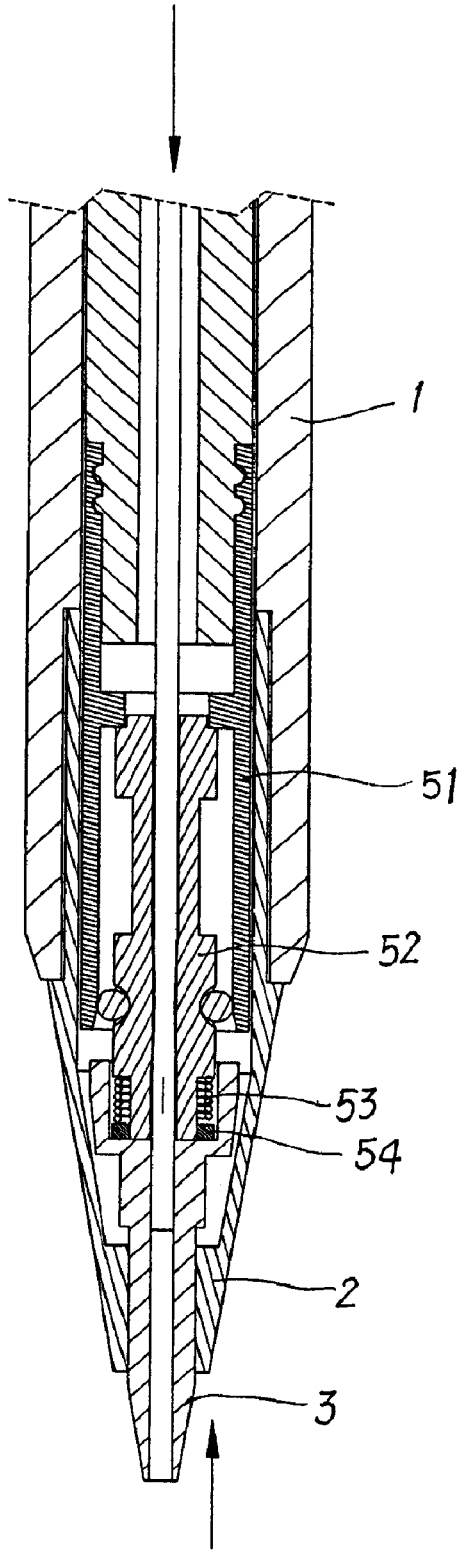

When the lead 7 is not extended out of the tip element 3 as shown in FIGS. 9 and 10, the lead 7 could be advanced by pressing the tip element 3 against the paper or the desk. When the tip element 3 is pressed, the spring 53 is compressed and a segment of the lead 7 is advanced into the tip element 3. And when the tip element 3 is raised from the paper or the desk, the resilience of the spring 53 pushes the tip element 3 downward. Due to the friction between the tip element 3 and the lead 7, the segment of the lead 7 is pulled downward by the tip element 3 as well. The process could be repeated a few times until the lead 7 is extended out of the tip element 3. Therefore, when the lead 7 outside the tip element 3 is used up, a user could press the tip element 3 and the lead 7 would be automatically extended as described above without depressing the top cap 4.

Figure 11:
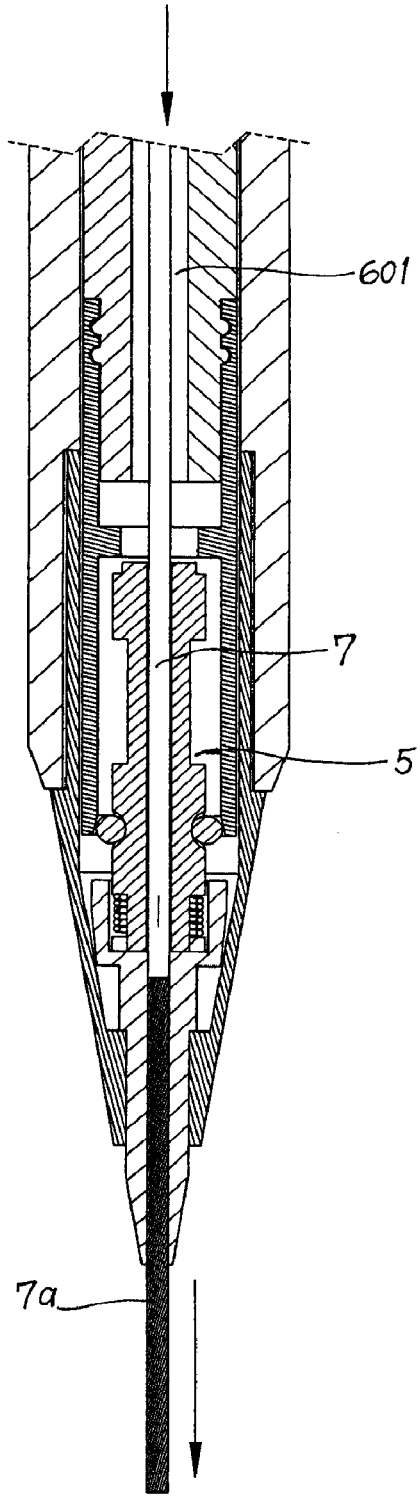
FIG. 11 is a sectional view diagram showing that a new lead is installed in the mechanical pencil of FIG. 1.

Additionally, when the lead 7 is used up to only a small segment 7*a* left which is not clamped by the clamping pieces 52, depressing the top cap 4 or pressing the tip element 3 wouldn't be able to advance the segment 7*a*. Then, a new lead 7 could be threaded into the axial channel 601 via the through hole 41 of the top cap 4. The new lead 7, as shown in FIG. 11, would be clamped by the clamping pieces 52. Then, by depressing the top cap 4 or by pressing the tip element 3, the new lead 7 would push the segment 7*a* out of the tip element 3, as described above. The segment 7*a* therefore is not wasted.

Compared to conventional mechanical pencils, the present invention has a number of advantages: (1) the present invention has a simplified structure contributing to a lower production cost and thereby a higher market competitiveness; (2) the lead could be advanced automatically by pressing the tip element against the paper or desk without depressing any button or cap; (3) the parts of the present invention are tightly joined together so that children couldn't easily disassemble it; and (4) the more economical design of using a single lead prevents the problem of multiple leads stuck at the tip.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A mechanical pencil, comprising:

a tubular body having an end-to-end axial channel;

a hollow bottom cap at a bottom end of said tubular body having a top opening and a bottom opening;

a tip element positioned inside said bottom cap and protruding downward through said bottom opening of said bottom cap;

a clamping means extending from said axial channel of said tubular body to said tip element, said clamping means having two clamping pieces laterally joined to form a cylindrical body having an end-to-end axial channel and two opposing indentations on the circumference of said cylindrical body, two balls inside said two indentations, and a spring between said cylindrical body and said tip element, and a tube into which said cylindrical body is threaded;

a sliding means inside said axial channel of said tubular body above said clamping means, said sliding means having an end-to-end axial channel capable of holding a lead; and a top cap at a top end of said tubular body, said top cap having a through hole at a top end of said top cap for threading said lead into said axial channel of said sliding means;

wherein said balls of said clamping means is confined by said tube of said clamping means to squeeze said clamping pieces to hold said lead; when said top cap is depressed, said spring is compressed and said balls roll into to a section of said tube which has a larger aperture to release said clamping pieces so that said lead is able to drop; when said top cap is released, said clamping pieces are pushed back into said tube by said spring so that said balls roll out of said section and again squeeze said clamping pieces to hold said lead; when said lead is not extended out of said tip element and said tip element is pressed, said spring is compressed and a segment of said lead is advanced into said tip element; and, when said tip element is released, said spring pushes said tip element downward and, due to the friction between said tip element and said lead, said segment of said lead is pulled downward by said tip element as well.

2. The mechanical pencil according to claim 1, wherein a washer is positioned between said spring and said tip element.

3. The mechanical pencil according to claim 1, wherein the diameter of said axial channel of said sliding means is gradually enlarged to a top opening of said axial channel.

* * * * *